US005131316A

United States Patent [19]

Lawrence et al.

[11] Patent Number: 5,131,316

[45] Date of Patent: Jul. 21, 1992

[54] AUTOLOADING APPARATUS FOR TANK CANNON

[75] Inventors: Keith E. Lawrence, Peoria, Ill.; Edward H. Behrens, Cheshire, Mass.; Robert E. Chiabrandy, Burlington, Vt.

[73] Assignee: General Electric Company, Schenectady, N.Y.

[21] Appl. No.: 731,164

[22] Filed: Jul. 12, 1991

[51] Int. Cl.[5] ..... F41A 9/16

[52] U.S. Cl. ..... 89/46; 89/47

[58] Field of Search ..... 89/45, 46, 47, 36.08

[56] References Cited

U.S. PATENT DOCUMENTS

| | | | |
|---|---|---|---|
| 470,285 | 3/1892 | Canet | 89/46 |
| 2,112,853 | 4/1938 | Lucht et al. | 89/46 |
| 3,106,866 | 10/1963 | Klapdohr et al. | 89/45 |
| 3,134,303 | 5/1964 | Sahlberg | 89/45 |
| 3,136,212 | 6/1964 | Girouard et al. | 89/46 |
| 3,314,332 | 4/1967 | Wallin | 89/47 |
| 3,988,962 | 11/1976 | Elwin | 89/46 |
| 4,038,906 | 8/1977 | Tidstrom | 89/46 |
| 4,381,693 | 5/1983 | Dumez | 89/46 |
| 4,388,854 | 6/1983 | Dabrowski et al. | 89/46 |
| 4,429,616 | 2/1984 | Grosser | 89/34 |
| 4,442,753 | 4/1984 | Pouri et al. | 89/46 |
| 4,481,862 | 11/1984 | Wiethoff et al. | 89/46 |
| 4,495,853 | 1/1985 | Gottwaldt | 89/46 |
| 4,727,790 | 3/1988 | DeHaven et al. | 89/46 |
| 4,823,675 | 4/1989 | Schiele et al. | 89/46 |
| 4,838,144 | 6/1989 | Bierwirth et al. | 89/46 |
| 4,998,458 | 3/1991 | Schiele et al. | 89/47 |

FOREIGN PATENT DOCUMENTS

| | | | |
|---|---|---|---|
| 308515 | 6/1917 | Fed. Rep. of Germany | 89/46 |
| 100865 | 2/1941 | Sweden | 89/46 |
| 2049120 | 12/1980 | United Kingdom | 89/36.08 |

*Primary Examiner*—Stephen Johnson

*Attorney, Agent, or Firm*—Robert A. Cahill

[57] ABSTRACT

An autoloader, capable of loading regardless of gun elevation, includes arcuate guide tracks mounted to the chute of a weapon pod protecting the breech of an exterior, turret-mounted gun. The guide tracks, of a radius of curvature centered on the gun elevation axis, mounts a trolley for guided movement between a lower magazine position and an upper gun loading position. A compact rammer, pivotally mounted to the trolley, extracts a shell from a magazine affixed to the turret floor while in the trolley magazine position and controls the shell during transfer to the trolley gun loading position. During shell transfer, the rammer is pivoted relative to the trolley to swing the shell out of the chute and into the pod to a ramming position aligning the shell with the gun boreline. The rammer then executes a two-stage ramming stroke to ram the shell into the gun breech. The trolley and rammer are powered by separate electric motors.

25 Claims, 10 Drawing Sheets

AUTOLOADING APPARATUS FOR TANK CANNON

The present invention relates to armament systems and particularly to apparatus for automating the handling of large caliber ammunition for turret-mounted cannons carried by armored vehicles, such as tanks.

BACKGROUND OF THE INVENTION

Considerable efforts by armament manufacturers throughout the world have been devoted to developing automated apparatus for handling ammunition for large field weapons. This is particularly so in the case of mobile direct-fire weapons carried by armored vehicles, such as tanks. Presently the tasks of withdrawing ammunition rounds or shells from magazine storage and loading them into the breech of a tank cannon are almost universally being accomplished manually. A person performing the duties of a gun loader is thus an essential member of a military tank crew. To accommodate his movement in retrieving shells from a magazine and ramming them into the cannon breech, considerable space must be allotted for these activities within the tank, more typically within the revolving gun turret of the tank. Adequate headroom should be provided so the gun loader can work standing up. Unfortunately, this increases the vertical profile of the tank and thus its size as a target to hostile fire. The turret must, therefore, be heavily armored to maximize tank and crew survivability against enemy fire. Of course, heavy armor plating adds tremendously to the weight of a tank, which then requires a larger power pack, drive train, and suspension.

The factors of greater overall profile and the consequences thereof, the elimination of a gun loader and the consequent space savings, and the prospect of higher firing rates have heretofore been the primary motivations for developing a satisfactory autoloader for tank cannons. New tank designs calling for an overhead cannon mounted exteriorly to the roof of a turret that is essentially flush with the deck of a tank have rendered autoloading a virtual necessity.

Of the numerous autoloaders seen in the prior art, most are highly complex, extraordinarily space-consuming, difficult to maintain and susceptible to frequent malfunction. Many of the existing designs require that the cannon return to a predetermined position, particularly in elevation, before automated loading can be effected. Thus, the cannon must be repeatedly removed from the target for reloading and returned for firing, a significant detriment to firing rate. Additionally, prior art autoloaders are powered by hydromechanical or electrohydraulic units which depend on the use of high pressure hydraulics. Thus, crew survivability may be compromised by the presence of highly flamable hydraulic fluid.

SUMMARY OF THE INVENTION

In accordance with the present invention, there is provided improved apparatus for feeding and loading ammunition rounds or shells into a tank cannon without human intervention. The autoloader apparatus of the invention operates to retrieve cannon shells from a magazine, convey the shells to the cannon and ram them into the cannon breech, all on an automated basis. The autoloader is of an extremely compact construction to operate within an extraordinarily small space envelope. Positive control of each shell is maintained throughout the process to ensure reliable handling while the tank is travelling over rough terrain. The capability of loading the gun regardless of its position in azimuth and elevation provides for a significant improvement in firing rate. Moreover, the autoloader of the present invention permits retrieval of a shell from a magazine with a previously loaded shell in the gun breech and ready to fire, thus permitting the step of transferring a shell from the magazine to the gun to be conducted at a reduced pace, therefore minimizing autoloader power requirements without jeopardizing firing rate.

To accomplish these objectives, the autoloader of the present invention includes a trolley which is mounted by a pair of opposed guide tracks for controlled movement between a magazine position where shells are retrieved from magazine storage within the basket of a revolving turret and a gun loading position from which shells are rammed into the breech of a turret-mounted gun. The guide tracks are affixed to a chute mounted with and opening into an armored weapon pod enclosing the breech end of the gun and thus move in azimuth and elevation with the gun.

The trolley carries an electric motor for propulsion along its guide tracks and a two-stage rammer which, in turn, carries its own propulsion electric motor. When the trolley is moved to its magazine position latched to the turret, a forward rammer stage is activated by the rammer motor to engage and extract a selected shell from the magazine. The trolley motor is then activated to propel the trolley and the extracted shell held by the rammer upwardly through the weapon pod chute from the confines of the turret basket toward the weapon pod. As the trolley approaches the chute opening into the weapon pod interior, a cam roller, linked to the trolley and rammer and operating in a cam track physically associated with one of the guide tracks, produces controlled pivotal movement of the rammer with respect to the trolley as the latter approaches its gun loading position. The rammer is thus articulated into the weapon pod to assume a latched ramming position with the shell aligned with the gun boreline. Also, at an appropriate time during this shell transfer step when the available space envelope permits, the rammer motor is energized to activate a rear rammer stage and retract the shell to a rear-most position on the rammer.

With the rammer in its ramming position, the rammer motor is again energized to activate the two rammer stages in succession to propel the shell forwardly into the gun breech. The trolley is then propelled by its motor back toward the magazine position as the rammer is pivoted back to its normal position with respect to the trolley. When the autoloader is in the latched magazine position, the weapon pod is cleared to accommodate gun recoil when the gun is fired.

Since the trolley guide tracks are mounted to the weapon pod chute and thus move with the gun in azimuth and elevation, gun loading is achieved at any gun position to accommodate rapid firing rates. Once a shell is committed to the gun and the trolley has returned to its magazine position, the next shell can be retrieved from the magazine. By virtue of the pivotal mounting of the rammer to the trolley, shell transfer from the magazine to the gun is achieved through a highly restricted space envelope. The two-stage rammer construction provides a compact rammer capable of generating the long rammer stroke necessary to fully ram a shell into the breech. Moreover, the sequence of steps can be reversed to download a committed shell from the gun to the magazine. Furthermore, the all electric propulsion approach of the present invention eliminates the use of high-pressure hydraulic components and the consequential hazards thereof.

The invention according comprises the features of construction, combination of elements and arrangement of parts, all as described below, and the scope of the invention will be indicated in the claims.

BRIEF DESCRIPTION OF THE DRAWINGS

For a full understanding of the nature and objects of the invention, reference may be had to the following Detailed Description taken in conjunction with the accompanying drawings, in which.

Corresponding reference numerals refer to like parts throughout the several views of the drawings.

DETAILED DESCRIPTION

Figure 1:
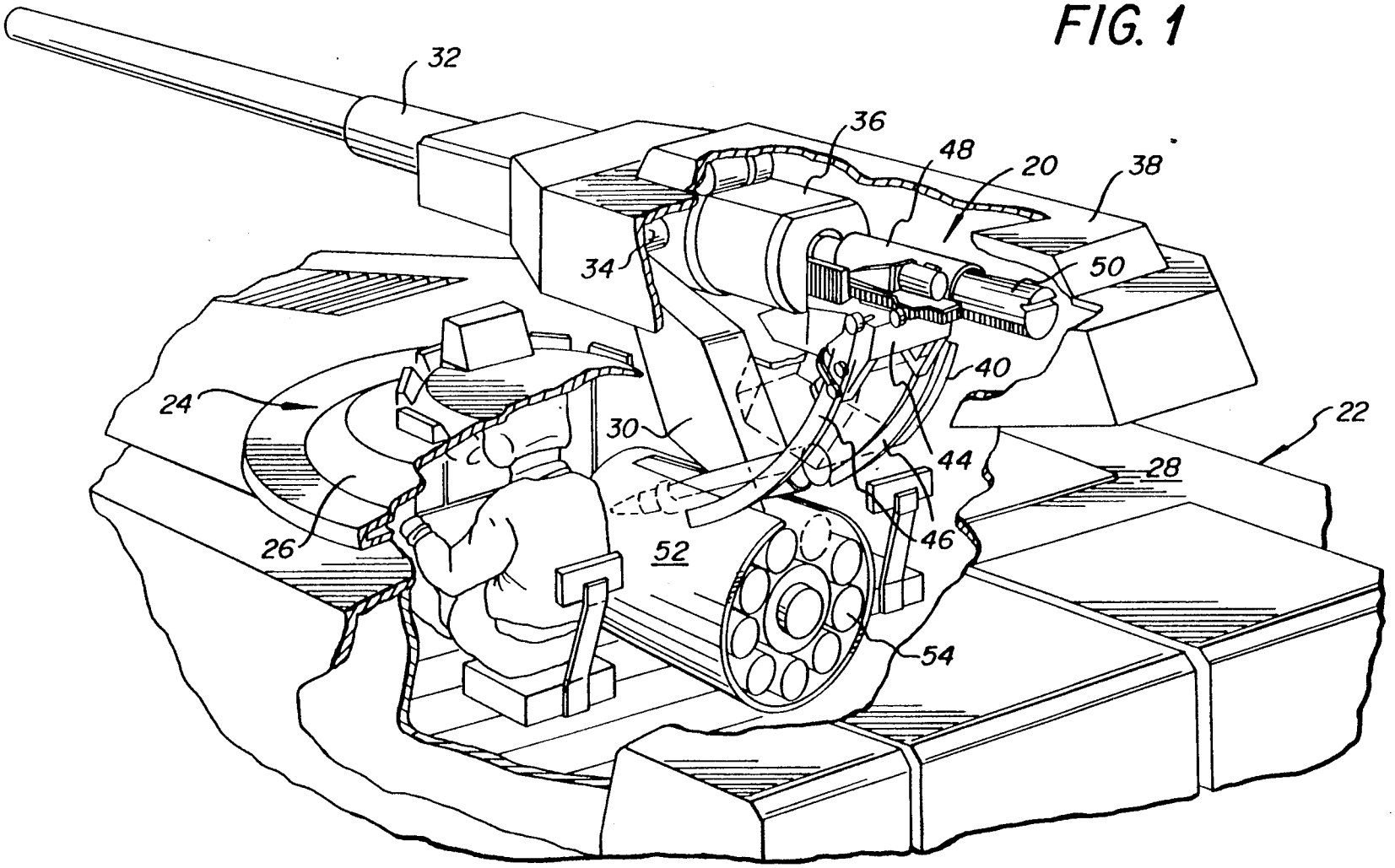
FIG. 1 is a perspective view, partially broken away, of an armored vehicle equipped with an overhead gun served by automated ammunition loading apparatus constructed in accordance with an embodiment of the present invention.
Figure 2:
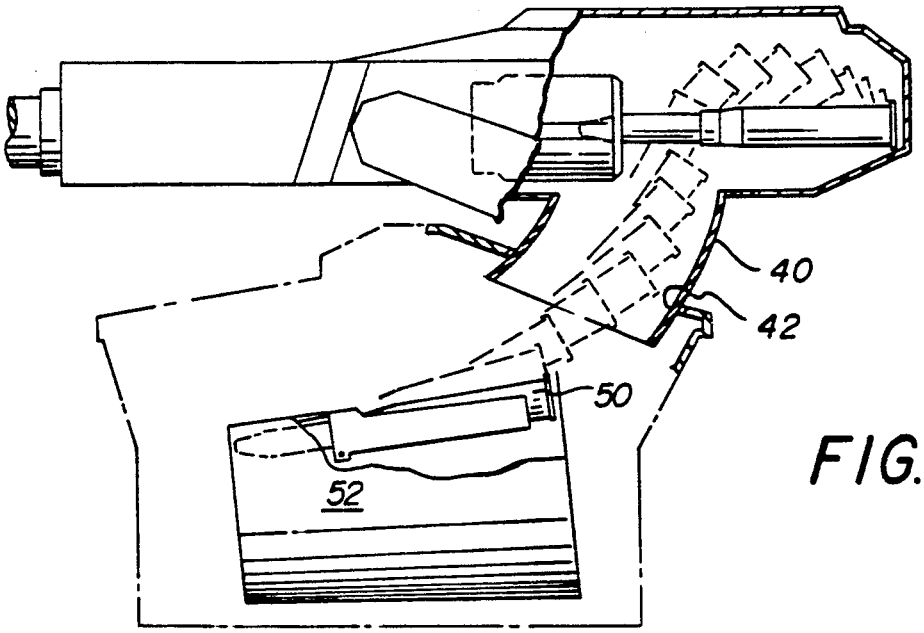
FIG. 2 is a simplified side elevational view, partially broken away, schematically illustrating in phantom the articulation of a shell achieved by the autoloading apparatus of FIG. 1 during movement between an ammunition storage magazine and the gun.
Figure 3:
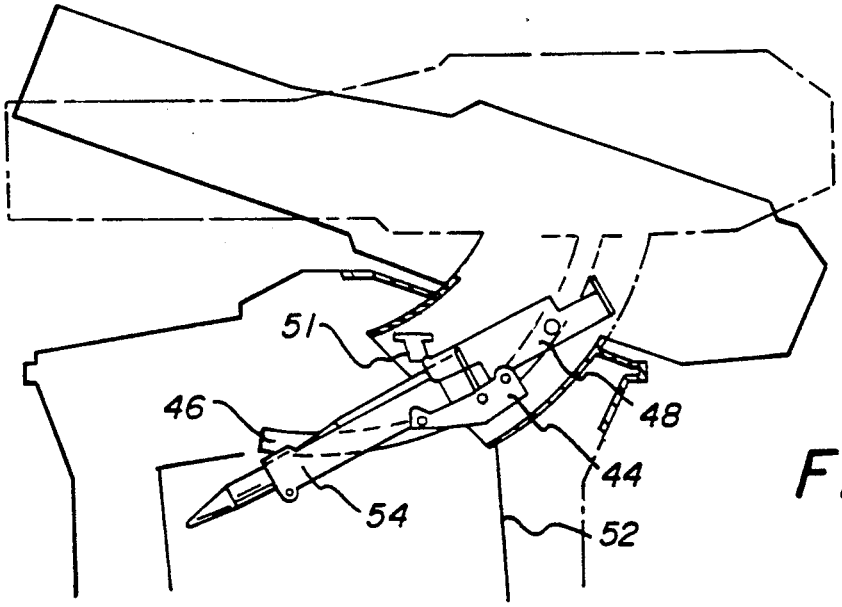
FIG. 3 is a simplified side elevational view illustrating the autoloading apparatus of FIG. 1 in its latched magazine position.

The autoloading apparatus of the present invention, generally indicated at 20 in FIG. 1, is illustrated in its application to an armored vehicle or tank 22 having a revolving turret, generally indicated at 24, whose roof 26 is essentially flush with the tank deck 28. Supports 30, upstanding from the turret roof, mount, via trunions 34, an overhead gun 32 for azimuthal movement with the turret and independent elevational movement about the trunnion axis. Enclosing the breech end 36 of the gun is an armored weapon pod 38 having chute 40 communicating the pod interior with the turret interior or basket through a turret opening 42 (FIG. 2). Autoloader 20 includes a trolley 44 equipped to run in opposed, arcuate guide tracks 46 mounted to sidewalls of chute 40; the guide tracks having a constant radius of curvature centered on the gun elevation axis constituted by the trunnions. The trolley mounts a rammer 48 for engagingly controlling a shell 50 through a feedpath illustrated in FIG. 2 during trolley movement along the guide tracks between a gun loading position illustrated in FIG. 1 and a magazine position illustrated in FIG. 3. In the gun loading position, the rammer is oriented to align the shell with the gun boreline so that it can be rammed into breech 36 by the rammer. In the magazine position releaseably fixed to the turret by a solenoid actuated latch 51 (FIG. 4), the rammer is oriented to acquire control of and retrieve a shell from a rotating drum magazine 52 presented by a tilted up tube 54 when oriented in the twelve o'clock position by a suitable drive mechanism (not shown). The magazine is tied to the turret basket floor and thus moves with the gun and autoloader in azimuth. FIG. 3 illustrates that while the autoloader is in its latched magazine position, changes in gun elevation do not affect the positional relationship of the autoloader and magazine; the guide tracks simply sweeping past the autoloader as the gun elevates and depresses. When the autoloader is latched to the weapon pod in its ramming position of FIG. 1 by a solenoid actuated latch 53 (FIG. 4), the trolley and rammer move with the gun in both agimuth and elevation. Intermediate these latched positions, the autoloader simply moves in the guide tracks as they follow changes in gun elevation. It will be noted that the length of the feed path varies with gun elevation. As is apparent from FIG. 3, at zero elevation the feed path between the magazine and gun is significantly longer than at an elevated position, such as a plus 18° elevation. It is thus seen that autoloader 20 is capable of performing the steps of retrieving shells from magazine storage, feeding them to the gun and ramming them into the breech, all while the gun is at any elevation or while the gun is being elevated and depressed. Autoloader 20 is thus capable of a high firing rate.

Figure 4:
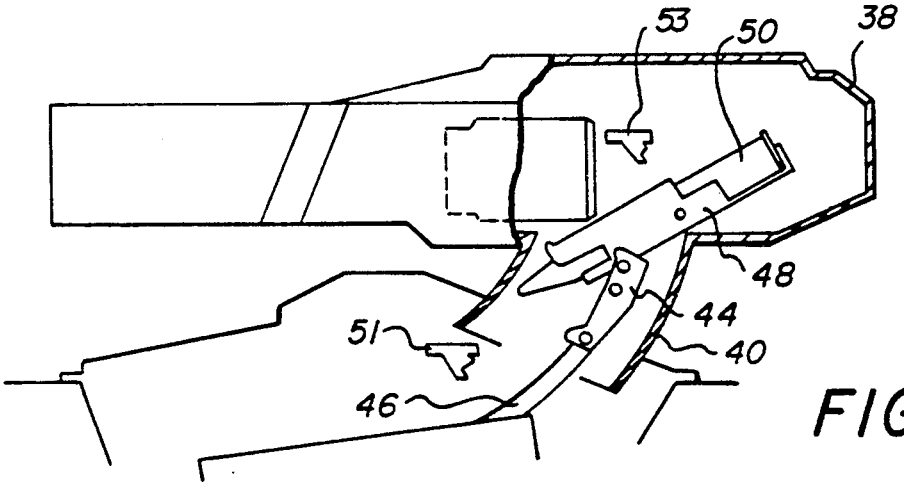
FIG. 4 is a simplified side elevational view illustrating the autoloading apparatus of FIG. 1 in a position between the magazine and gun loading positions.
Figure 5A:
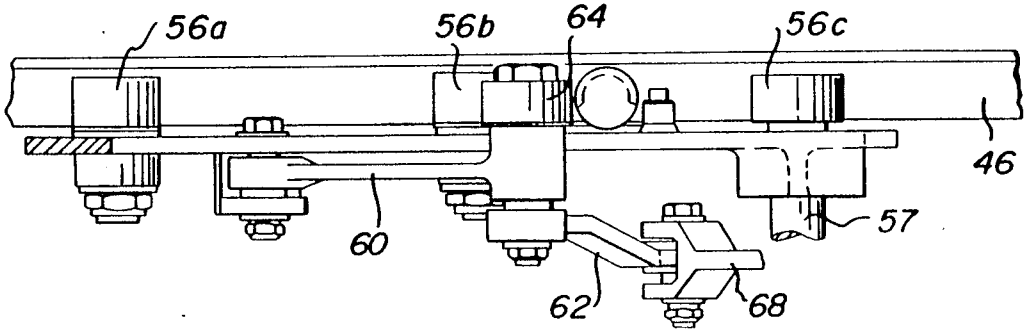
FIGS. 5*a* and 5*b* are fragmentary views illustrating the pivoting mechanical linkage between the trolley and rammer included in the autoloading apparatus of FIG. 1.
Figure 5B:
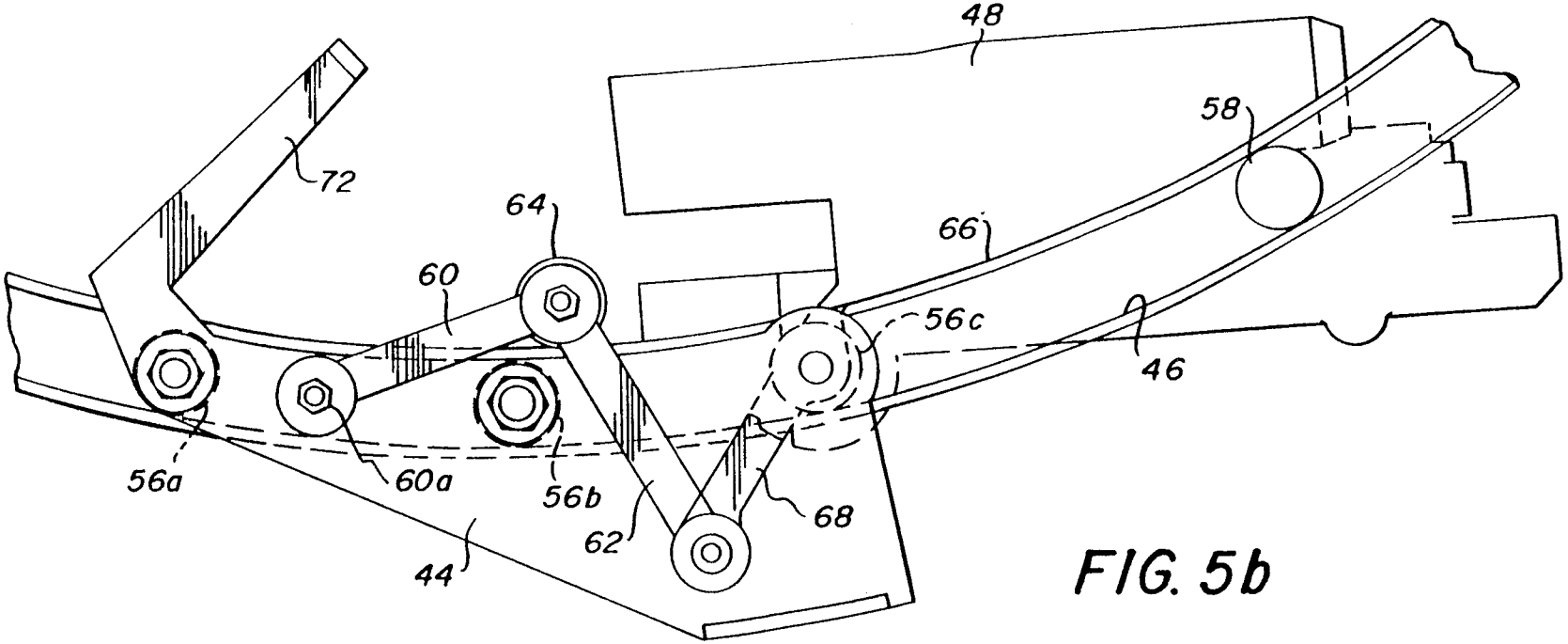

To execute the maneuver illustrated in FIG. 4 of articulating rammer 48 and its shell 50 out of the open upper end of chute 40 into ramming position within pod 38 aft of the gun breech consistent with the imposed space limitations, the rammer is pivotally mounted to trolley 44. Referring to FIGS. 5*a* and 5*b*, the trolley mounts two opposed sets of three guide rollers 56*a*, 56*b* and 56*c*, which run in the two guide tracks 46. The pair of opposed rollers 56*c* are mounted on a cross shaft 57 which, as will be seen in FIG. 8, serves as an axle pivotal mounting the rammer to the trolley. The rammer mounts a pair of opposed guide rollers 58 which also run in the guide tracks until the start of the pivot maneuver when they exit the upper ends of the tracks. One end of a trolley link 60 is pivotally connected to the trolley at 60*a*, while its other end is pivotally connected to one end of a rammer link 62. The pivotal connection of these two links also serves to mount a trolley cam roller 64 which is seen in FIG. 5*b* to be riding on a cam surface 66 provided by the inner wall of one of the guide tracks. The other end of link 62 is pivotally connected to a rammer control arm 68 provided as a rigid extension of the rammer.

Figure 6:
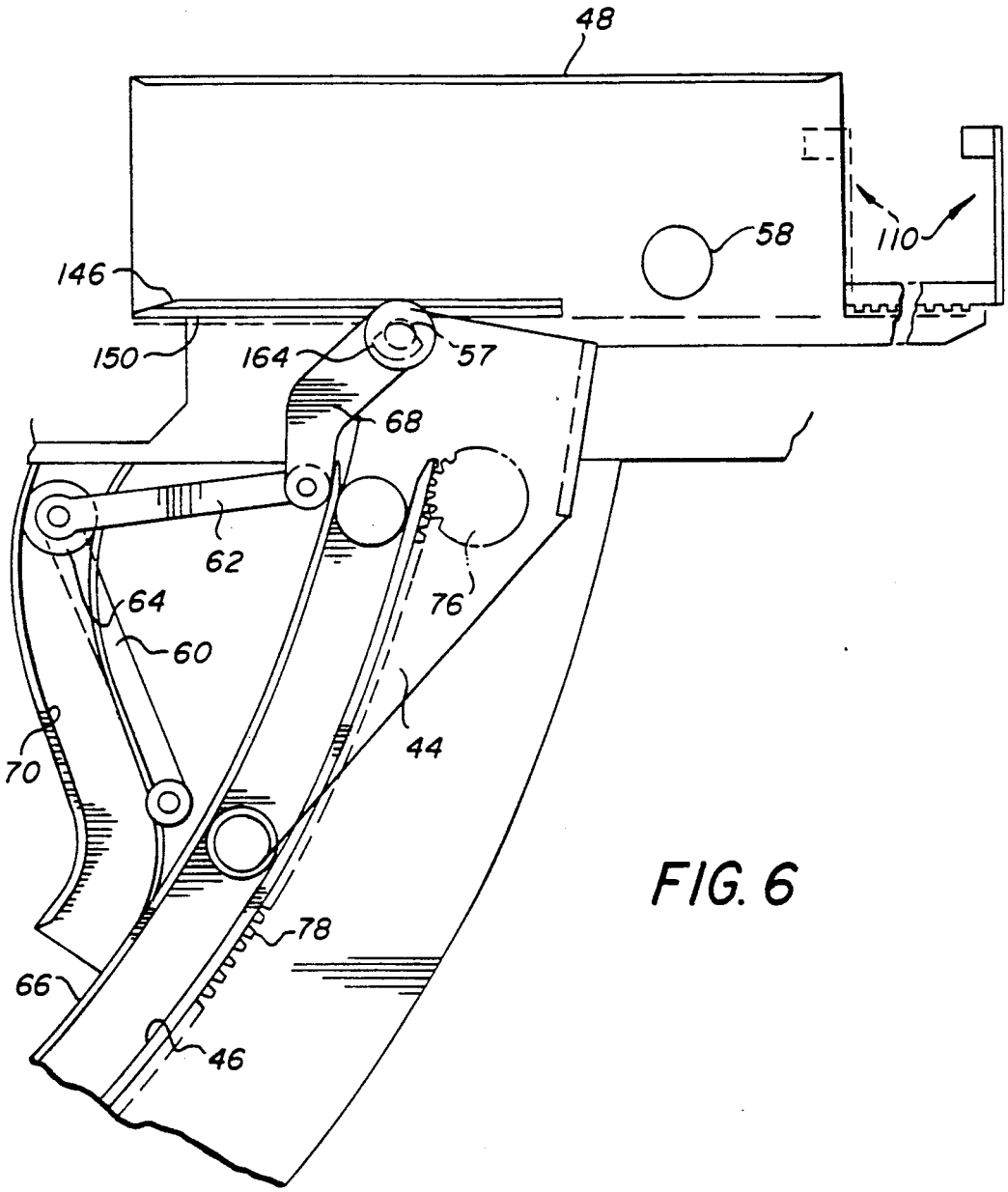
FIG. 6 is a fragmentary side elevational view illustrating the trolley and rammer in their relative positions when the autoloading apparatus of FIG. 1 assumes its gun loading position.

Turning to FIG. 6, wherein trolley 44 is shown in its gun loading position with rammer 48 pivoted away to its ramming position, it is seen that cam roller 64 has been diverted from cam surface 66 into a cam track 70 diverging inwardly away from one of the guide tracks 46. This is seen to articulate links 60 and 62 such as exert a moment on rammer control arm 68 to produce controlled pivoting motion of the rammer about cross shaft 57 in the illustrated clockwise direction. Note that rammer guide rollers 58 have exited the upper ends of the guide tracks to free the rammer for this pivoting motion progressively into its ramming position as cam roller 64 runs up in cam track 70. FIG. 5*b* also illustrates a extension of trolley 44 which serves as a latch arm 72 engaged by the solenoid actuated latch 51 of FIG. 3 to releaseably lock the trolley in its magazine position.

Figure 7:
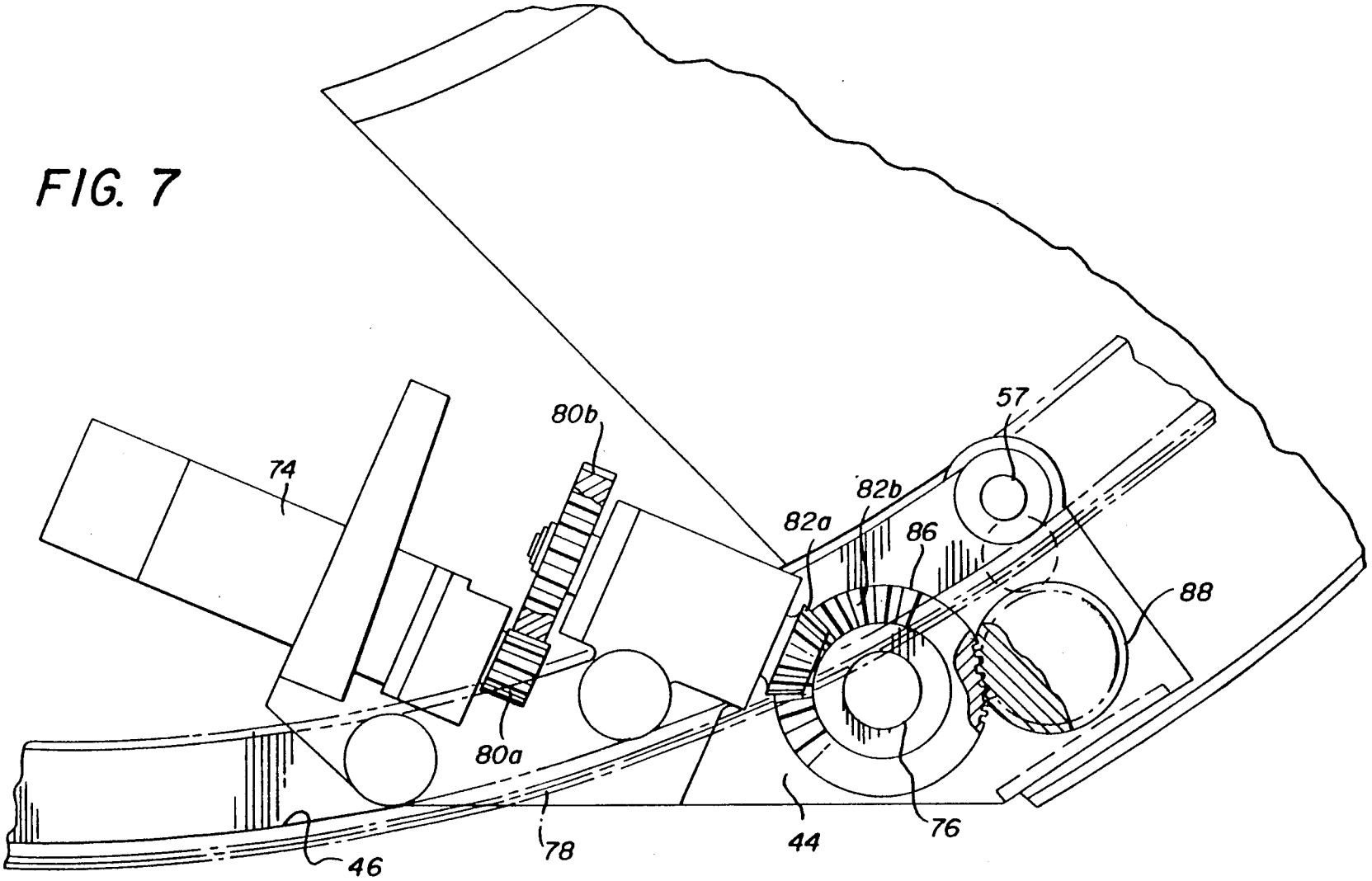
FIG. 7 is a fragmentary side elevational view illustrating the trolley drive gear train.
Figure 8:
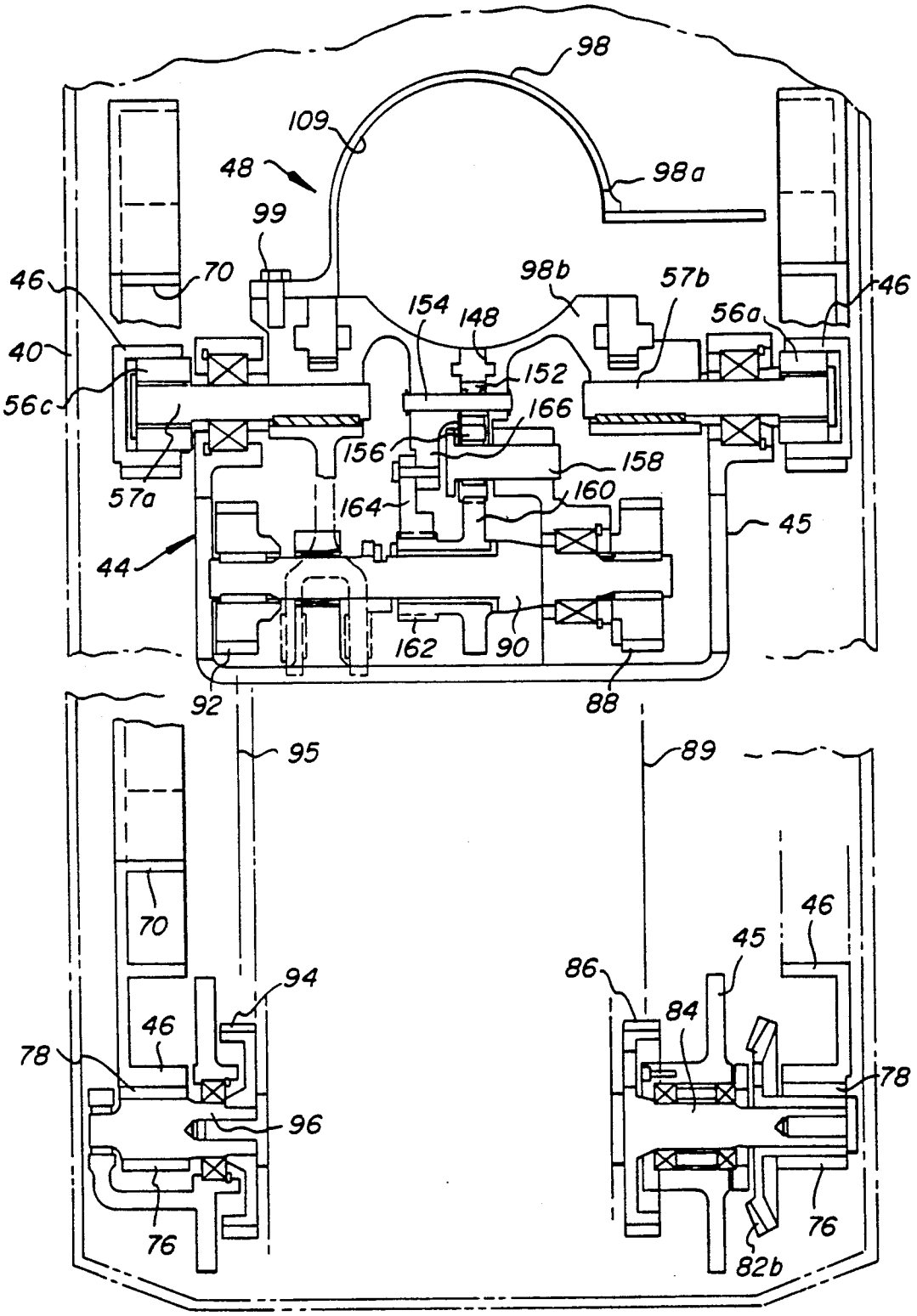
FIG. 8 is a partially exploded sectional view illustrating details of the trolley and rammer drive train.

To propel the trolley 44 along its guide tracks 46, an electric motor 74 is mounted to the trolley frame, as seen in FIG. 7, to drive a pair of output pinions 76 which engage sector gears 78 formed in the outer walls of the two guide tracks 46, as also seen in FIG. 6. Referring jointly to FIGS. 7 and 8, the motor drives a set of spur gears 80*a* and 80*b* and a set of bevel gears 82*a* and 82*b*, with the right side bevel gear 82*b* affixed with the right side output pinion 76 on a stub shaft 84 of a spur gear 86 journalled by the trolley frame 45. Spur gear 86 meshes with a spur gear 88 (arrow 89) affixed to the right end of a cross shaft 90 also journalled by the trolley frame as seen in the exploded view of FIG. 8. Fixed to the left end of this cross shaft is a spur gear 92 which meshed with a spur gear 94 (arrow 95) affixed to the inner end of a stub shaft 96 journalled by the trolley frame 45 and on which the left side drive pinion 76 is keyed. It is thus seen that the dual output pinions 76 are commonly driven by the motor in meshing engagement with the two guide track sector gears 78 to produce smooth, non-binding motion in the guide tracks. The output pinions are permitted to free-wheel when the trolley is latched in its magazine position to accommodate movements of the sector gear and guide tracks with elevating motion of the gun.

Figure 9:
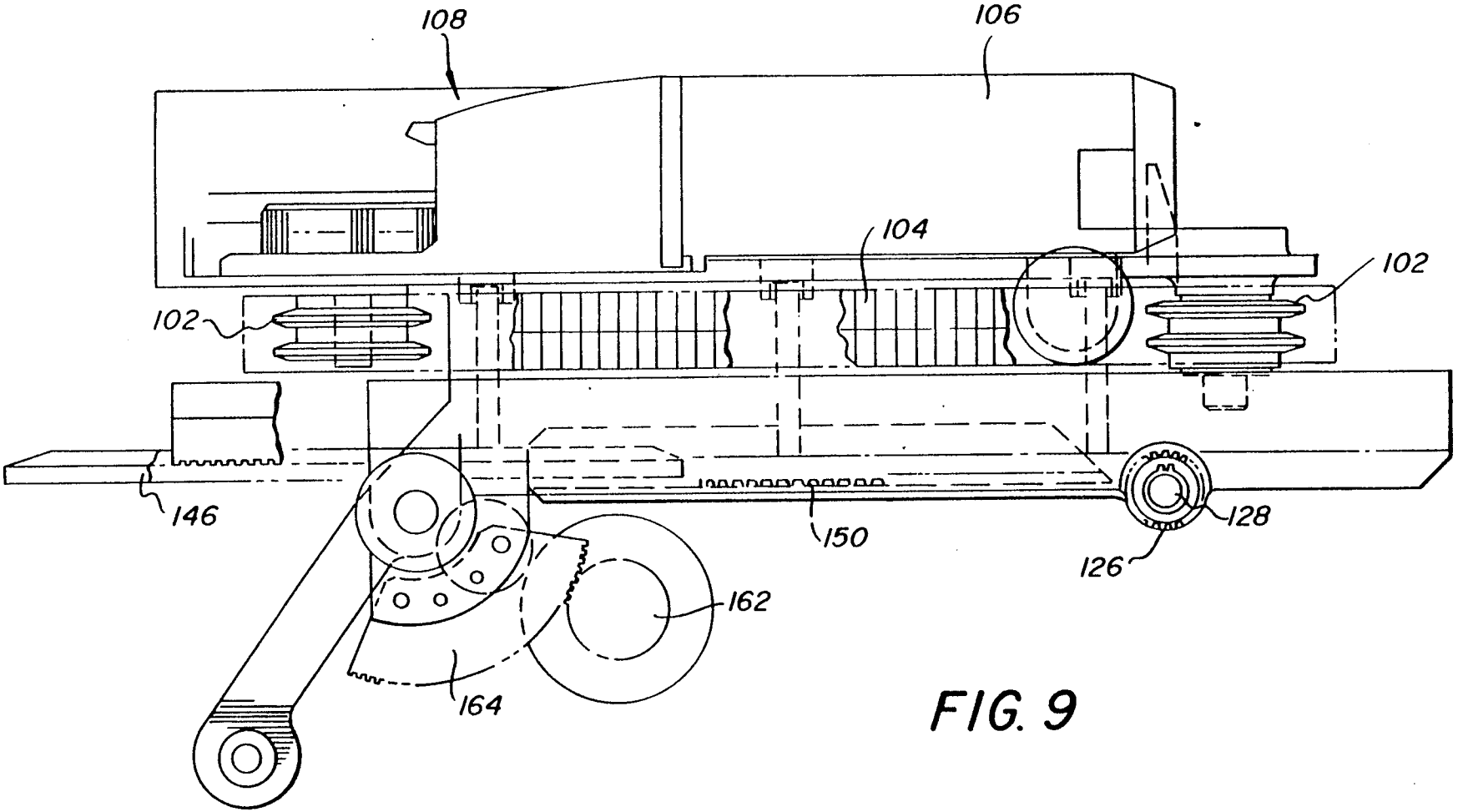
FIG. 9 is a side elevational view depicting details of the two-stage rammer of FIG. 6.
Figure 10:
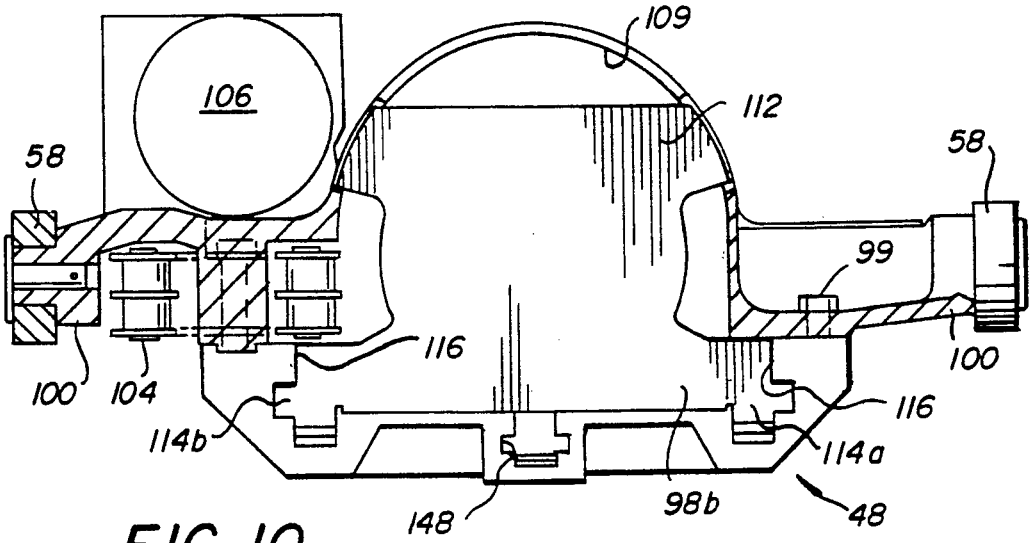
FIG. 10 is an rear end view, partially in section, of the rammer of FIG. 9.

Rammer 48 includes, as seen in FIGS. 8, 9 and 10, a generally tubular housing 98 consisting of an upper half 98*a* and a lower half 98*b* united by bolts 99 (FIG. 8). The upper housing half is formed with lateral extensions 100 for mounting at their ends the rammer guide rollers 58 seen in FIG. 10 and also in FIG. 6, which run in guide tracks 46 prior to the rammer pivoting motion. As seen in FIG. 8, lower housing half 98*b* is affixed to rammer pivot axle 57 which consists of a pair of axially aligned stubs shafts 57*a* and 57*b* which are journalled in the trolley frame 45 and rotatably mount at their outer ends the guide rollers 56*c* running in guide tracks 46, as described in connection with FIGS. 5*a* and 5*b*. The upper housing half mounts a pair of longitudinally spaced dual sprockets 102 about which an endless, double-row roller chain 104 is trained, as best seen in FIG. 9. An electric motor 106, mounted by rammer housing 98, drives the forward sprocket through a gear train, generally indicated at 108, to power two rammer stages. The tubular portion of the rammer housing is sized to receive a shell in close fitting relation to provide support and guidance therefor.

Figure 11:
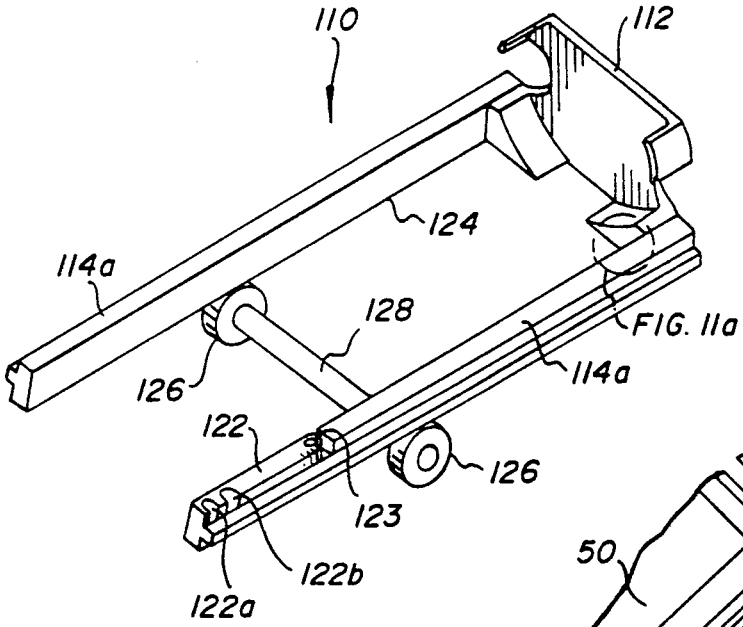
FIG. 11 is a perspective view of the rear stage of the rammer of FIG. 9.
Figure 11A:
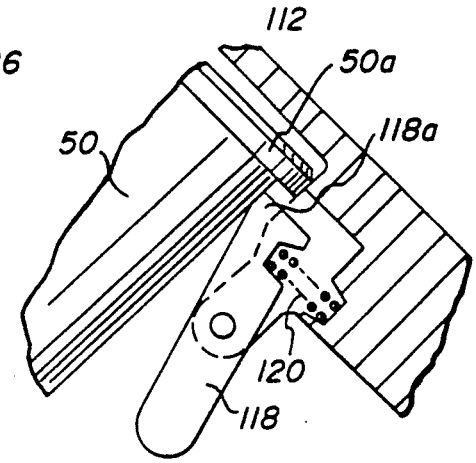
FIG. 11*a* is a magnified perspective view of a portion of the rear rammer stage of FIG. 11.

As best seen in FIG. 11, rammer 48 includes a rear rammer stage, generally indicated at 110, having a base 112 and a pair of forwardly extending rails 114*a* and 114*b* which are slidingly received in trackways 116 formed in lower housing half 98*b* (FIG. 10). The base is seen to provide underlying support for the case rim of a shell and also serves as a ramming element propelling the shell toward the gun breech. As seen in FIG. 11*a*, adjacent the junction of rail 114*b* with base 112, an extractor pawl 118 is pivotally mounted with its tip 118*a* biased inwardly by a spring 120 to catch the front edge of the case rim 50*a* of a shell 50 residing in the tubular rammer housing. The case rim is thus captured between the pawl tip and base 112 to positively control the shell position during shell-feeding autoloader movement between its magazine and gun positions and rammer pivotal movement into its ramming position. An accelerator link 122 is pivotally mounted by a pin 123 to the forward end of rail 114*b* and is provided with a pair of notches 122*a* and 122*b*, the latter positioned to pick up a drive pin carried by chain 104 to drive the rear rammer stage between a forward stowed position within the rammer housing and a rearward, extended position seen in FIG. 6. The undersides of the rails are formed with rack gears 124 which mesh with spur gears 126 keyed to the ends of a cross shaft 128 journalled by the lower rammer housing half, as best seen in FIG. 9. Thus, driving power applied by chain 104 to stroke the rear rammer stage is distributed equally to the rails via these spur and rack gears to assure smooth, non-binding motion.

Figure 12A:
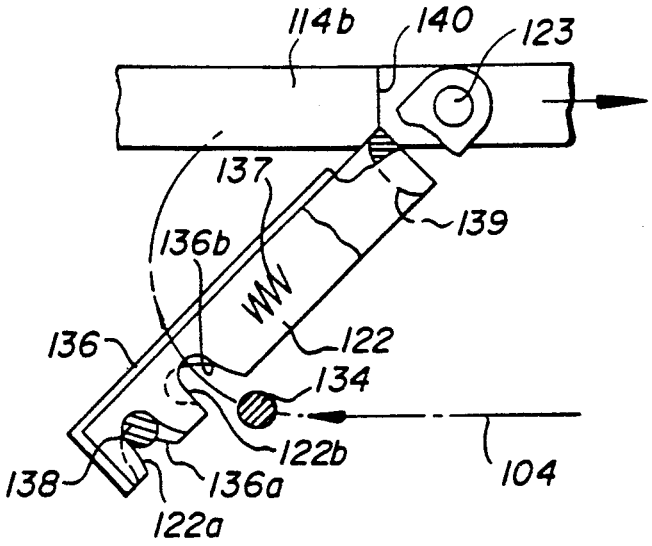
FIGS. 12*a*, 12*b* and 12*c* are fragmentary plane views illustrating features of the chain drive for the rear rammer stage of FIG. 9.
Figure 12B:
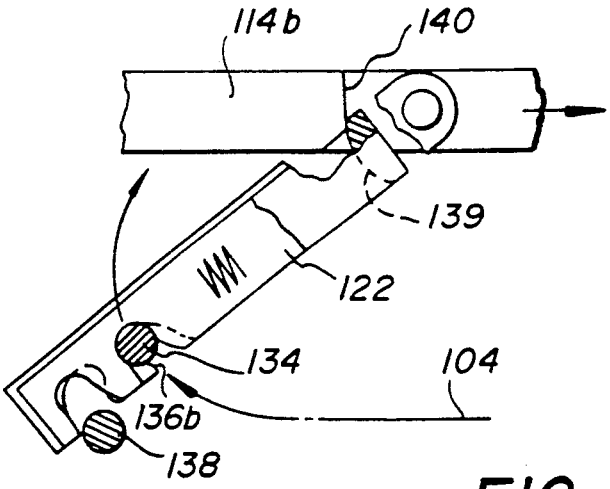
Figure 12C:
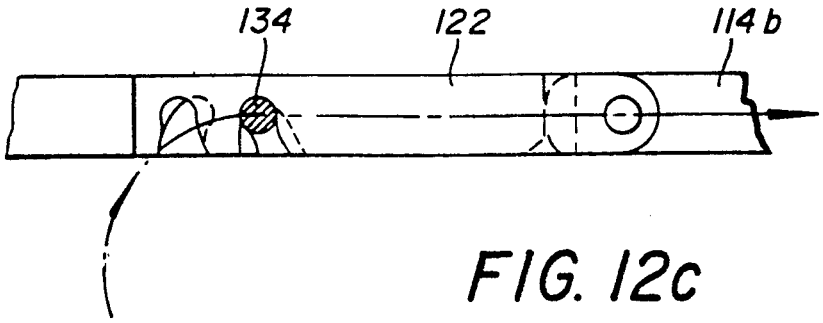

FIGS. 12*a*, 12*b* and 12*c* show further details of the rear rammer stage accelerator link 122. As seen in FIG. 12*a*, a retention link 136 is mounted to the accelerator link 122 for longitudinal sliding movement and includes latching notches 136*a* and 136*b* in substantial registry with accelerator link notches 122*a* and 122*b*, respectively. A spring, schematically indicated at 137, biases the retention link longitudinally outward away from accelerator link pivot pin 123, such that its notch 136*a* latches a retention pin 138 in accelerator link notch 122*a*. Pin 138 is mounted by the rammer housing to establish a precise accelerator link pickup position relative to a drive pin 134 carried by chain 104. When drive pin 134 swings clockwise around the forward sprocket 102, it is intercepted by link notches 122*b* and 136*b*. The pin strikes the exposed edge of notch 136*b* to cam retention link toward pivot pin 123 and thereby unlatches retention pin from notches 122*a* and 136*a*, as depicted in FIG. 12*b*. In the process, the drive pin becomes latched in notch 122*b* by the now underlying edge of notch 136*b*. This drive pin latching position of retention link 136 is maintained against the bias of spring 137 by an arcuate surface 139 thereof swinging into engaging relation with a retention surface 140 forward on rail 114*b* (FIG. 12*b*).

As the accelerator link is pivoted in the clockwise direction by the drive pin swinging around the forward sprocket, the rear rammer stage is smoothly accelerated from standstill up to the speed of chain 104 achieved when the accelerator link assumes an aligned position with rail 114*b* and the inner chain run (FIG. 12*c*). This action propels the rear rammer stage rearwardly from its phantom line nested position in the rammer housing to its solid line extended position seen in FIG. 6 as the drive pin moves with the inner chain rim to the rear sprocket and occurs during trolley motion toward its gun loading position at a time when space is available in the chute and weapon pod. Once the rear rammer stage reaches its full rearward extension, the rammer motor is halted with drive pin 134 still latched to the accelerator link 122 to await the call for a ramming stroke. The rear rammer extractor pawl 118 of FIG. 11*a* ensures that the shell follows the rear rammer stage to its extended position.

Figure 13:
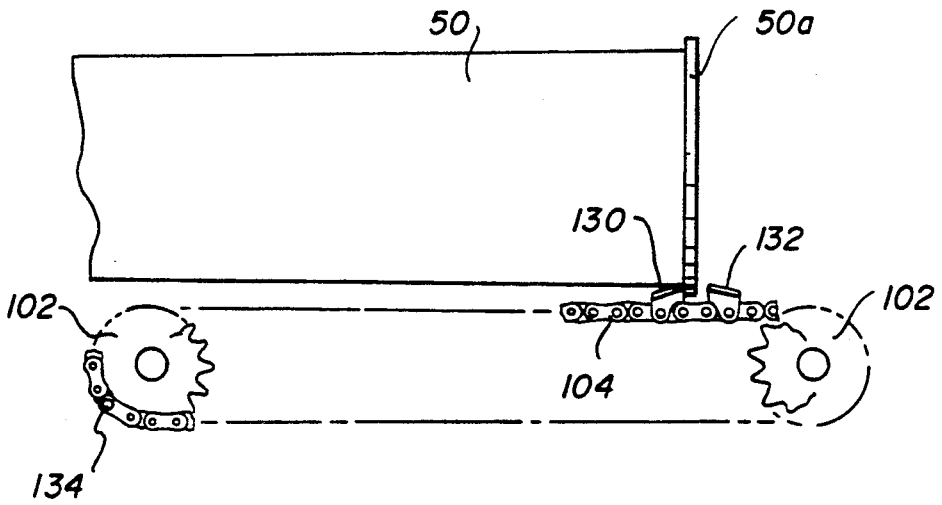
FIG. 13 is a fragmentary plane view illustrating details of the forward stage of the rammer of FIG. 8.

The forward rammer stage consists of a extractor pawl 130 and a rammer pawl 132 pivotally mounted by chain 104 in proximately spaced relation, as seen in FIG. 13. These pawls are spring biased outwardly to position their tips in closely straddling relation with the case rim 50*a* of a shell 50 residing in the tubular rammer housing. When the chain is driven in the clockwise direction, such that its inner run proximate the shell is moving rearwardly (rightward in FIG. 13), extractor pawl 130 swings around the forward sprocket 102 to catch the forward edge of the case rim and propel the shell rearwardly toward the rear rammer stage in its telescoped forward position of FIG. 8. It will be appreciated that rammer pawl 132 is depressed by the shell rim as it swings around the forward sprocket in advance of the extractor pawl. This operation occurs when the autoloader is in its magazine position to retrieve a shell from magazine 52 as described in connection with FIG. 3.

When chain 104 is driven in the opposite direction, such that its inner run is moving in the forward direction, extractor pawl 130 is depressed by the shell rim as it swings counterclockwise around the rear sprocket, clearing the way for rammer pawl 132 to catch the rear edge of the case rim and propel the shell forwardly. This action occurs during the forward stroke of the forward rammer stage, which is the second half of the ramming stroke to propel the shell into the gun breech; the forward stroke of the rear rammer constituting the first half of the ramming stroke. FIG. 13 also shows the relationship of pawls 130 and 132 to the rear rammer stage drive pin 134 carried by chain 104.

Figure 14A:
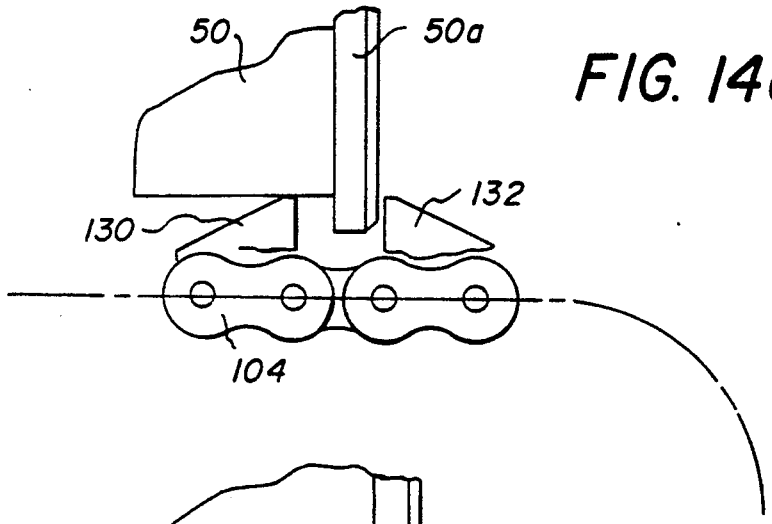
FIGS. 14*a* and 14*b* are fragmentary plan views in time line relation to illustrate the transfer of a shell from the rear to the forward rammer stages.
Figure 14B:
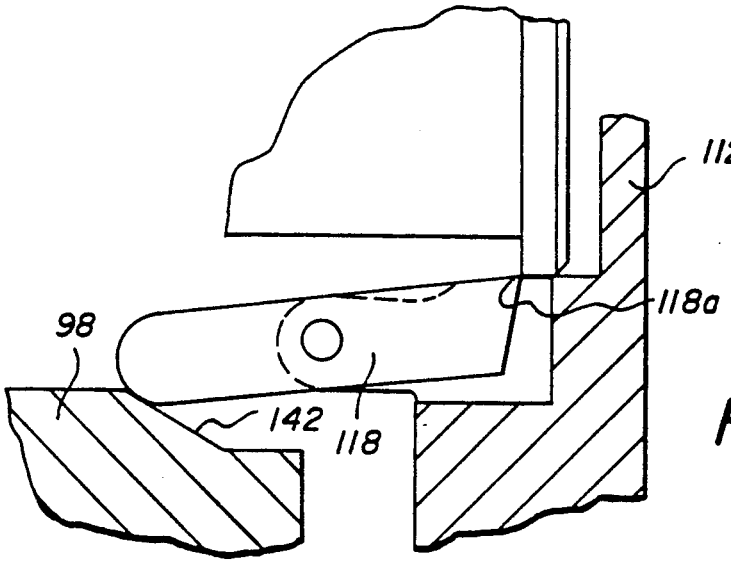

The smooth transfer or handoff of the shell from the rear rammer stage to the forward runner stage when the second half of the ramming stroke takes over from the first half is illustrated in FIGS. 14*a* and 14*b*. At the moment forward rammer pawl 132 swings counterclockwise around the rear sprocket to take over forward driving engagement with the case rim 50*a* from base 112, the tip 118*a* of rear extractor pawl is being swung away from the case rim by engagement of the rear extractor pawl with a cam surface 142 formed on the rammer housing 98. At the same time, drive pin 134 swings counterclockwise around the forward sprocket, bringing with it the accelerator link (FIG. 12*b*). The rear rammer stage is thus smoothly decelerated from the chain speed. Retention link surface 139 swings away from retention surface 140 as retention pin 138 enters accelerator link notch 122*a*. Retention link is thus freed to spring to its retention pin latch and drive pin release position under the bias of spring 137. The drive pin exits accelerator link notch 122*b*, leaving the rear rammer stage at a full stop with the accelerator link latched to the retention pin.

The handoff of a shell from the forward rammer stage to the rear rammer stage during the magazine loading step is effected basically in a reverse manner. The drive pin picks up the accelerator link to accelerate the rear rammer stage up to chain speed. Upon achieving chain speed, which is slower than the chain speed during the ramming stroke, the rear extractor pawl is in position relative to the front edge of the case rim to take over shell retraction from the front extractor pawl as it starts around the rear sprocket and swings away from the case rim. Thus, the shell is smoothly handed off from the front rammer stage to the rear rammer stage to complete retrieval of a shell from the magazine. Typically, the rear rammer stage will only execute a partial rearward stroke sufficient to acquire positive control of the shell and to clear the shell from the tilted up magazine tube (FIG. 3). This rearward stroke is completed when space becomes available during the shell transfer step.

When the shell is released by the ramming pawl of the front rammer stage to conclude the forward stroke of the rammer, the shell casing has sufficiently entered the gun bore to permit the shell to coast into its fully loaded position, in the process triggering the breech mechanism extractors to initiate breech closure. To ensure shell alignment as it coasts from the front rammer stage into the gun breech, the rammer incorporates a guide tongue 146 seen in FIGS. 6 and 9. The guide tongue is slidingly received in a keyway 148 formed in lower rammer housing half 98*b* (FIGS. 8 and 10). The underside of the guide tongue is machined to provide a rack gear 150 which meshes with a spur gear 152 carried on a shaft 154 mounted by the lower rammer housing half, as seen in FIG. 8. This spur gear meshes with an idler gear 156 carried by a trolley mounted shaft 158, which, in turn, meshes with pinion gear 160 journalled on trolley cross shaft 90. Integrally formed with pinion gear 160 is a pinion gear 162 in position to mesh with a sector gear 164 affixed to an appendage 166 of lower rammer housing half 98*b*.

Turning to FIG. 9, when the rammer is pivoted into its ramming position in reaction to cam roller 64 moving into cam track 70 (FIG. 6), the swinging motion of sector gear 164 drives the guide tongue forwardly to an extended position via pinion gears 162, 160, idler gear 156, spur gear 152 and rack gear 160. When the rammer pivots back to its closed position with respect to the trolley as the autoloader departs its gun position, the sector gear swings in the opposite direction to retract the guide tongue to its telescoped, stowed position within the rammer housing. In addition to aligning a shell during the ramming step, the guide tongue serves to guide a previously committed shell as it is ejected back out to the first rammer stage. A buffer (not shown) is incorporated in the rammer to absorb the impact of the ejected shell and bring it to rest within the rammer tube. The rammer stages then operate in the same manner as when retrieving a shell from the magazine to position the shell on the rammer for movement back to the magazine. The rammer then executes a slow speed ramming stroke to return the shell to magazine storage.

From the foregoing description of the rammer, it is seen that its two stage construction provides a ramming stroke that is considerably longer than the rammer length. The compact rammer package is necessary to provide clearance for gun recoil at maximum elevation, as can be seen from FIG. 3.

While the autoloader of the present invention has been disclosed in its application serving an overhead gun, it will be appreciated that it is applicable as well to a tank cannon whose breech is enclosed by a conventional turret.

It is seen from the foregoing that the objectives set forth, including those made apparent from the Detailed Description, are efficiently attained, and, since certain changes may be made in the construction set forth, it is intended that matters of detail be taken as illustrative and not in a limiting sense.

Having described the invention, what is claimed as new and desired to secure by Letters Patent is:

1. Automated apparatus for loading shells into the breech of a gun mounted by the revolving turret of an armored vehicle, said apparatus comprising, in combination:

A. a shell storage magazine mounted by the turret at a location beneath the gun breech;

B. a trolley;

C. a rammer mounted by said trolley and including means for gripping a shell;

D. at least one arcuate guide track mounted by structure moveable in azimuth and in elevation with the gun and having a radius of curvature centered on the elevating axis of the gun, said guide track guiding said trolley during movement between a magazine position and a gun loading position, said rammer being activated with said trolley in said magazine position to extract a shell from said magazine with said gripping means and being activated with said trolley in said gun loading position to ram the shell into the gun breech with said gripping means, thereby to permit shell extraction from said magazine and shell ramming into the gun breech without regard to gun elevation.

2. The automated loading apparatus defined in claim 1 which includes a transversely opposed pair of said guide tracks to provide support and guidance for said trolley.

3. The automated loading apparatus defined in claim 2 which further includes means for latching said trolley to the turret while in said magazine position, thereby fixing the trolley position relative to said magazine despite movement of said guide tracks during elevating motion of the gun.

4. The automated loading apparatus defined in claim 3, wherein said rammer is pivotally mounted to said trolley, said apparatus further includes means for pivoting said rammer relative to said trolley into a ramming position aligning a shell held by said gripping means with the gun boreline as said trolley achieves said gun loading position.

5. The automated loading apparatus defined in claim 4, wherein said pivoting means includes a cam track commonly mounted with at least one of said guide tracks, and a cam roller running in said cam track and linked with said trolley and rammer.

6. The automated loading apparatus defined in claim 5, which further includes an electric trolley motor carried by said trolley for propelling said trolley between said magazine and gun loading positions.

7. The automated loading apparatus defined in claim 6, which further includes an electric rammer motor carried by said rammer for activating said gripping means in extracting a shell from said magazine and ramming the shell into the gun breech.

8. The automated loading apparatus defined in claim 6, which further includes a sector gear associated with at least one of said guide tracks and a pinion gear meshing with said sector secs and driven by said trolley motor to propel said trolley between said magazine and gun loading positions.

9. Automated apparatus for loading shells into the breech of a gun mounted by the revolving turret of an armored vehicle, said apparatus comprising, in combination:

A. a shell storage magazine mounted by the turret at a location beneath the gun breech;

B. a trolley having two sets of distributed guide rollers;

C. a rammer mounted by said trolley and including means for engaging the casing rim of a shell to control the position thereof on said rammer; and D. a pair of opposed arcuate guide tracks mounted by structure movable in elevation with the gun and having a constant radius of curvature centered on the elevating axis of the gun, said guide rollers running in said guide tracks to support and guide said trolley for movement between a magazine position, where said engaging means are activated to extract a shell from said magazine, and a gun loading position where said engaging means are activated to ram the shell into the gun breech.

10. The automated loading apparatus defined in claim 9, which further includes an electric rammer motor carried by said rammer.

11. The automated loading apparatus defined in claim 10, wherein said rammer includes forward and rear rammer stages powered by said rammer motor through linearly aligned strokes, and said engaging means includes forward elements for engaging the case rim of a shell in said forward rammer stage and rear elements for engaging the case rim in said rear rammer stage, the shell case rim being transferred between said forward and rear elements to propel a shell through the combined strokes of said forward and rear rammer stages.

12. The automated loading apparatus defined in claim 11, wherein said rammer includes an endless chain trained about forward and rear sprockets bidirectionally driven by said rammer motor to power said first and second rammer stages strokes.

13. The automated loading apparatus defined in claim 12 wherein said forward elements consist of a forward extractor pawl and a forward rammer pawl carried by said chain in opposed, closely spaced relation, said forward extract pawl engaging the case rim to extract a shell from said magazine during a rearward stroke of said forward rammer stage, and said forward rammer pawl engaging the case rim to ram a shell into the gun breech during a forward stroke of said forward rammer stage.

14. The automated loading apparatus defined in claim 13, wherein said rammer includes a housing having a tubular section receiving a shell for support and guidance, said housing mounting said forward and rear sprockets, said rear rammer stage including a pair of parallel spaced, forwardly extending rails telescopically mounted by said rammer housing and an upstanding base carried by corresponding rear ends of said rails, said base providing underlying support for the case rim of a shell residing in said tubular housing section, said chain drivingly engaging one of said rails to propel said rear rammer stage through forward and rearward strokes.

15. The automated loading apparatus of claim 14, wherein said chain carries a drive pin and said rear rammer stage further includes an accelerator link pivotally mounted at one end to a forward end portion of one of said rails, said accelerator link including a drive notch adjacent the free end thereof, said accelerator link being oriented in a pickup position to capture said drive pin in said drive notch as said drive pin moves around said forward sprocket and into a linear chain run toward said rear sprocket, whereby to smoothly accelerate said rear rammer stage from standstill up to linear chain velocity to begin a rearward stroke of said rear rammer stage, said drive pin being released from said drive notch while moving around said forward sprocket and out of said linear chain run from said rear sprocket to smoothly decelerate said rear rammer stage to a stop with said accelerator link in said pickup position to conclude a forward stroke of said rear rammer stage.

16. The automated loading apparatus defined in claim 15, wherein said accelerator link further includes a retention notch for receiving a retention pin mounted by said housing to establish said accelerator link pickup position.

17. The automated loading apparatus defined in claim 16, wherein said rear elements consist of a rear extractor pawl for engaging the case rim to propel a shell rearwardly during a rearward stroke of said rear rammer stage and said base for engaging the case rim to propel a shell forwardly toward said forward rammer stage during a forward stroke of said rear rammer stage, said forward rammer pawl moving around said rear sprocket into engagement with the case rim at the conclusion of said rear rammer stage forward stroke to begin said forward rammer stage forward stroke culminating in the ramming of a shell into the gun breech.

18. The automated loading apparatus defined in claim 17, which further includes means for latching said trolley to the turret while in said magazine position, thereby fixing the trolley position relative to said magazine despite movement of said guide tracks during elevating motion of the gun.

19. The automated loading apparatus defined in claim 18, which further includes additional latching means for latching said rammer to said guide track mounting structure while in said gun loading position.

20. The automated loading apparatus defined in claim 18, wherein said rammer is pivotally mounted to said trolley, said apparatus further includes means for pivoting said rammer relative to said trolley into a ramming position aligning a shell held by said gripping means with the gun boreline as said trolley achieves said gun loading position.

21. The automated loading apparatus defined in claim 20, wherein said pivoting means includes a cam track commonly mounted with at least one of said guide tracks, and a cam roller running in said cam track and linked with said trolley and rammer.

22. The automated loading apparatus defined in claim 21, which further includes an electric trolley motor carried by said trolley for,. propelling said trolley between said magazine and gun loading positions.

23. The automated loading apparatus defined in claim 22, which further includes a sector gear associated with at least one of said guide tracks and a pinion gear meshing with said sector gear and driven by said trolley motor to propel said trolley between said magazine and gun loading positions.

24. The automated loading apparatus defined in claim 23, wherein said rammer further includes a guide tongue telecopically mounted by said rammer housing and gearing means driven in response to the pivoting motion of said rammer into said ramming position to extend said guide tongue forwardly out of said rammer housing to guide a shell during concluding coasting motion into the gun breech following disengagement of said forward rammer pawl from the casing rim at the conclusion of the forward stroke of said forward rammer stage.

25. The automated apparatus defined in claim 9, wherein the gun is an overhead gun mounted atop the turret roof, and the guide track mounting structure is the chute of a weapon pod enclosing the gun breech.

* * * * *